US009131560B2

(12) United States Patent
Williams et al.

(10) Patent No.: US 9,131,560 B2
(45) Date of Patent: Sep. 8, 2015

(54) PORTABLE LAMP SYSTEM

(71) Applicants: Patricia Williams, Willow Park, TX (US); Christin Marie Ellis, Cresson, TX (US); Warren Vincent Norred, Arlington, TX (US)

(72) Inventors: Patricia Williams, Willow Park, TX (US); Christin Marie Ellis, Cresson, TX (US); Warren Vincent Norred, Arlington, TX (US)

( * ) Notice: Subject to any disclaimer, the term of this patent is extended or adjusted under 35 U.S.C. 154(b) by 0 days.

(21) Appl. No.: 14/146,372

(22) Filed: Jan. 2, 2014

(65) Prior Publication Data

US 2015/0189704 A1 Jul. 2, 2015

(51) Int. Cl.

| | |
|---|---|
| ***F21L 4/00*** | (2006.01) |
| ***H05B 33/08*** | (2006.01) |
| ***F21S 6/00*** | (2006.01) |
| ***F21S 9/02*** | (2006.01) |
| ***F21L 2/00*** | (2006.01) |
| ***F21L 4/08*** | (2006.01) |
| ***F21V 23/06*** | (2006.01) |

(52) U.S. Cl.

CPC ..... *H05B 33/0803* (2013.01); *F21L 2/00* (2013.01); *F21L 4/08* (2013.01); *F21S 6/002* (2013.01); *F21S 6/005* (2013.01); *F21S 9/02* (2013.01); *F21V 23/06* (2013.01)

(58) Field of Classification Search

CPC ..... F21S 6/002; F21S 6/003; F21S 6/005; F21S 6/007; F21S 9/02; F21L 2/00; F21L 4/08; F21V 21/28; F21V 23/06; F21V 23/0435; F21V 23/006; H05B 33/0803; H05B 33/0815; H05B 33/0827; H05B 33/0854

USPC ..... 362/157, 183, 190, 20, 295, 276, 235, 362/249, 217, 253, 414, 431; 315/86, 84, 315/152

See application file for complete search history.

(56) References Cited

U.S. PATENT DOCUMENTS

| | | | | |
|---|---|---|---|---|
| 7,322,718 | B2 * | 1/2008 | Setomoto et al. | 362/276 |
| 7,824,061 | B1 * | 11/2010 | Riedfort et al. | 362/183 |
| 7,897,277 | B2 * | 3/2011 | Meyer et al. | 429/100 |
| 8,770,806 | B2 * | 7/2014 | Koo et al. | 362/374 |
| 2009/0154148 | A1 * | 6/2009 | Meyer et al. | 362/157 |
| 2010/0039792 | A1 * | 2/2010 | Meyers et al. | 362/20 |
| 2013/0148338 | A1 * | 6/2013 | Chen et al. | 362/183 |

* cited by examiner

*Primary Examiner* — Vibol Tan

(74) *Attorney, Agent, or Firm* — Warren V. Norred

(57) ABSTRACT

The present disclosure provides a user-configurable battery-powered LED lamp. The lamp has several embodiments to handle recharging, including hot-swap battery cartridges, a wireless alert system, and redundant battery supplies. The system also has a light-shaping feature to shine light in user-defined areas with shaped light-emitting surfaces.

2 Claims, 8 Drawing Sheets

PORTABLE LAMP SYSTEM

TECHNICAL FIELD OF THE DISCLOSURE

The present disclosure relates generally to a portable lighting system for indoor and outdoor use.

BACKGROUND OF THE DISCLOSURE

Portable lighting is used in homes where wired power is not easily available. Older homes that predate the modern era of ubiquitous computing and electronics, and have limited access. Owners of such homes often desire lighting in an area but wish to avoid lengthy extension cords.

To achieve their lighting goals, home owners have resorted to battery-powered lamps. However, even modern battery-powered lamps are not sufficiently bright, or have inadequate battery life to function for a significant time. They also tend to be esthetically undesirable, as they are not intended for daily use, but occasional temporary situations, such as a power outages or camping.

Even those cordless lighting solutions that are offered on the market for permanent household solutions are simply not bright enough, such as those offered by Modern Lantern, provide LED lighting equivalent to only a standard incandescent 40 W bulb. (For an example of these products, see United States Patent Application 20120188754, Cordless Decorative Lamp, by Stephen Travis Fitzwater.)

Additionally, battery-powered lamps eventually run out of power, even those using more energy efficient LEDs instead of incandescent bulbs. Users of such products must be prepared to either change out batteries, cease using the lamp until it is recharged, or continuously monitor battery charge levels.

Finally, battery-powered lamps tend to have the same problem that all lamps have, in that they often waste power and light by shining light toward walls instead of living areas. In situations where AC power is readily available, this is often a non-critical aspect of operation, but in limited DC systems, the waste of battery power has the very real result of shorter battery lives.

The lighting market needs high quality lighting systems that provide lighting equivalent to at least 60 W incandescent bulbs, and meet the challenges of battery power source replacement and recharge as discussed infra.

SUMMARY OF THE DISCLOSURE

The present disclosure provides a user-configurable battery-powered LED lamp. The lamp has several embodiments to handle recharging, including hot-swap battery cartridges, a wireless alert system, and redundant battery supplies. The system also has a light-shaping feature to shine light in user-defined areas with shaped light-emitting surfaces.

Other features and advantages of the present disclosure will be apparent to those of ordinary skill in the art upon reference to the following detailed description taken in conjunction with the accompanying drawings.

BRIEF DESCRIPTION OF THE DRAWINGS

For a better understanding of the disclosure, and to show by way of example how the same may be carried into effect, reference is now made to the detailed description along with the accompanying figures in which corresponding numerals in the different figures refer to corresponding parts and in which the drawings show several embodiments.

DETAILED DESCRIPTION OF THE DISCLOSURE

While the making and using of various embodiments of the present disclosure are discussed in detail below, it should be appreciated that the present disclosure provides many applicable inventive concepts, which can be embodied in a wide variety of specific contexts. The disclosure is primarily described and illustrated hereinafter in conjunction with various embodiments of a battery-powered LED lamp. The specific embodiments discussed herein are, however, merely illustrative of specific ways to make and use the disclosure and do not limit the scope of the disclosure to the specific context disclosed.

As discussed in the background of the disclosure, the current industry offering for battery-powered lamp has lackluster brightness, inadequate battery life, and sprays light toward all directions equally, often wasting that created light by shining it against walls, instead of living area.

Figure 5:
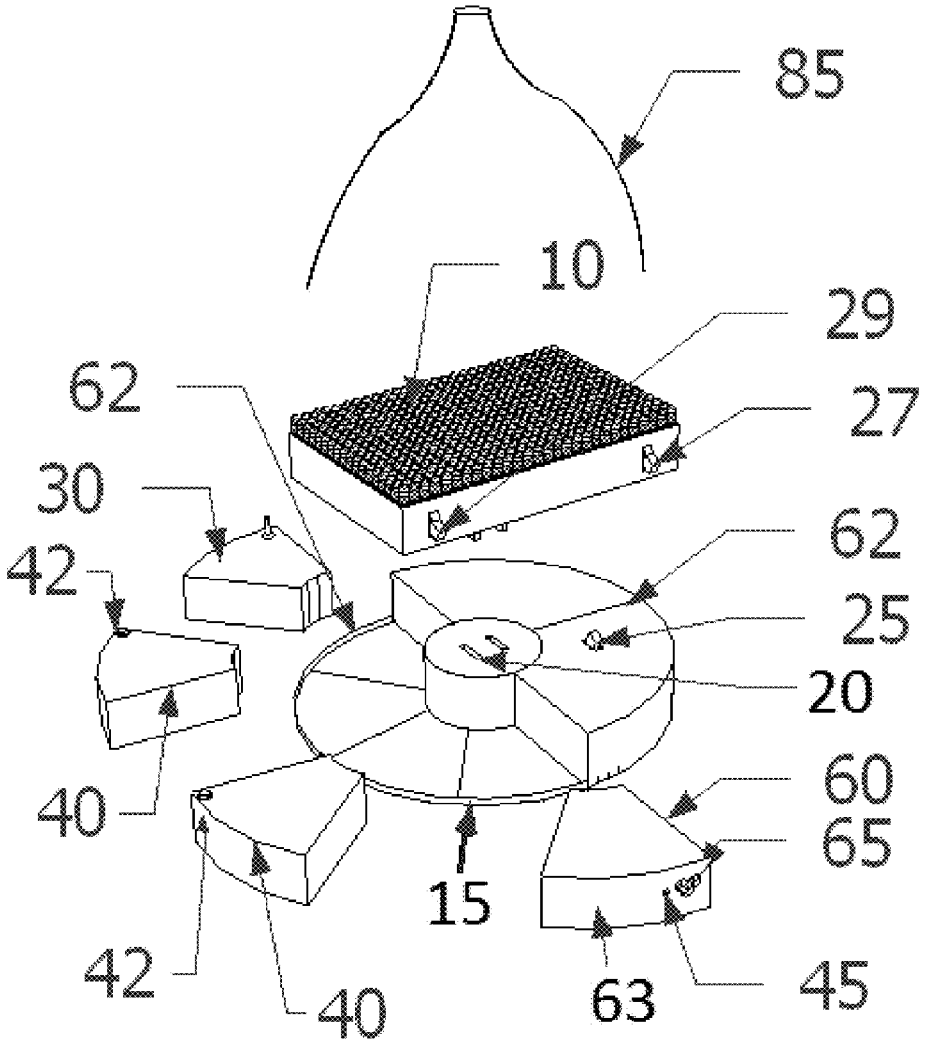
FIG. 5 shows an exploded view of one embodiment of the Housing 15.

As shown in FIG. 5, the invention is a battery-powered Lamp 5, and comprises a Power Control Module 60, a Lighting Control Module 20, Lighting Surface 10, Shade Mount 85, and Load Slots 62 into which one or more dc Battery Packs 40, an External Power Source Module 95 containing a DC Power Inlet Connector 45 and AC Power Inlet Plug 65, and a Wireless Communication Module 30 may be installed. These elements are affixed on or in a Housing 15, or constructed into modules that latch onto the Housing as shown in FIG. 5. An optional Wireless Base Station 70 is also employed when the Wireless Communication Module is used. Details and functions of these components follow.

The Power Control Module 60 converts various incoming power sources, including dc power from one or more Battery Packs 40, ac power received through an AC Power Inlet Plug 65, or DC Power Inlet Connector 45, whichever is present. After conversion of the incoming power supplies, the Power Control Module 60 supplies stable dc power of one or more voltages to the Lighting Control Module 20 and Wireless Communication Module 30 (if present). These two loads on the supply may have multiple conditioned outputs, as necessary to power their respective loads.

As shown in FIG. 5, the Power Control Module 60 is configurable, with up to four Load Slots 62. All four Load Slots 62 have physical and electrical connections to accept a Battery Pack 40. However, one of the Slots 62 is capable of also accepting a Wireless Control Module 30. A second Slot 62 also capable of accepting an External Power Module 63, explained below.

As shown in FIG. 5, the External Power Module 63 is a similar size to a Battery Pack 40, but instead of battery cells, the External Power Module 63 contains the AC Power Inlet Plug 65 and DC Power Inlet Connector 45 and power associated conversion circuitry, rather than their permanent construction in the Housing 15. In an embodiment using the External Power Module 63, a user can choose to use an additional Battery Pack 40 instead of having the option of an AC or DC power source.

The Power Control Module 60 can be constructed using industry known techniques to allow a universal input of ac power (85V to 165 Vac), or a range of dc power that fits the particular application, typically 9-18 Vdc, but potentially a wider range of 9-24 Vdc or more. The Lamp 5 is not limited to any one single available design, but must deliver power at the current rate and voltage levels required by the Lamp's Lighting Surface 10 and Wireless Communication Module 30.

For example, it is a simple matter to use a 48 Vdc nominal supply voltage and takes no undue experimentation to convert that voltage to any number of lower voltages, typically 12V, 5V, 3.3V, because commercially available modules are available from Vicor, Ericsson and other dc-dc conversion module makers, or printed-circuit-board chip solutions, such as chip maker National Semiconductors p/n LM2575HV that produces 12V/1 A from up to 60V using an off-the-shelf cookbook design that would satisfy the needs of the optional Wireless Communication Module 30. Innumerable similar options exist to satisfy the power needs of each electronic component of the Lamp 5.

When ac power is available at the AC Power Inlet Plug 65 or dc power is available at the DC Power Inlet Connector 45 is available, the Power Control Module may be constructed to charge the Battery Packs 40 as well as provide the power the Lighting Control Module 20 and Wireless Communication Module 30 (if present).

When more than one Battery Pack 40 is present, the Power Control Module 60 may be constructed to deplete power from one Battery Pack 40 at a time; the Power Control Module 60 then shifts to a second Battery Pack 40 and awaits charge of the depleted Pack 40. Alternatively, the Power Control Module may treat all installed Battery Packs 40 as one source and deplete them uniformly.

The Lamp 5 may be constructed with a hot-swap option, in that while ac power is present at the external AC Power Inlet Plug 65 or dc power is available at the DC Power Inlet Connector 45, the Lamp 5 can continue to operate while Battery Packs 40 are exchanged. A user can unlatch, remove and replace a Battery Pack 40 while the Lamp continues to shine uninterrupted.

Figure 3:
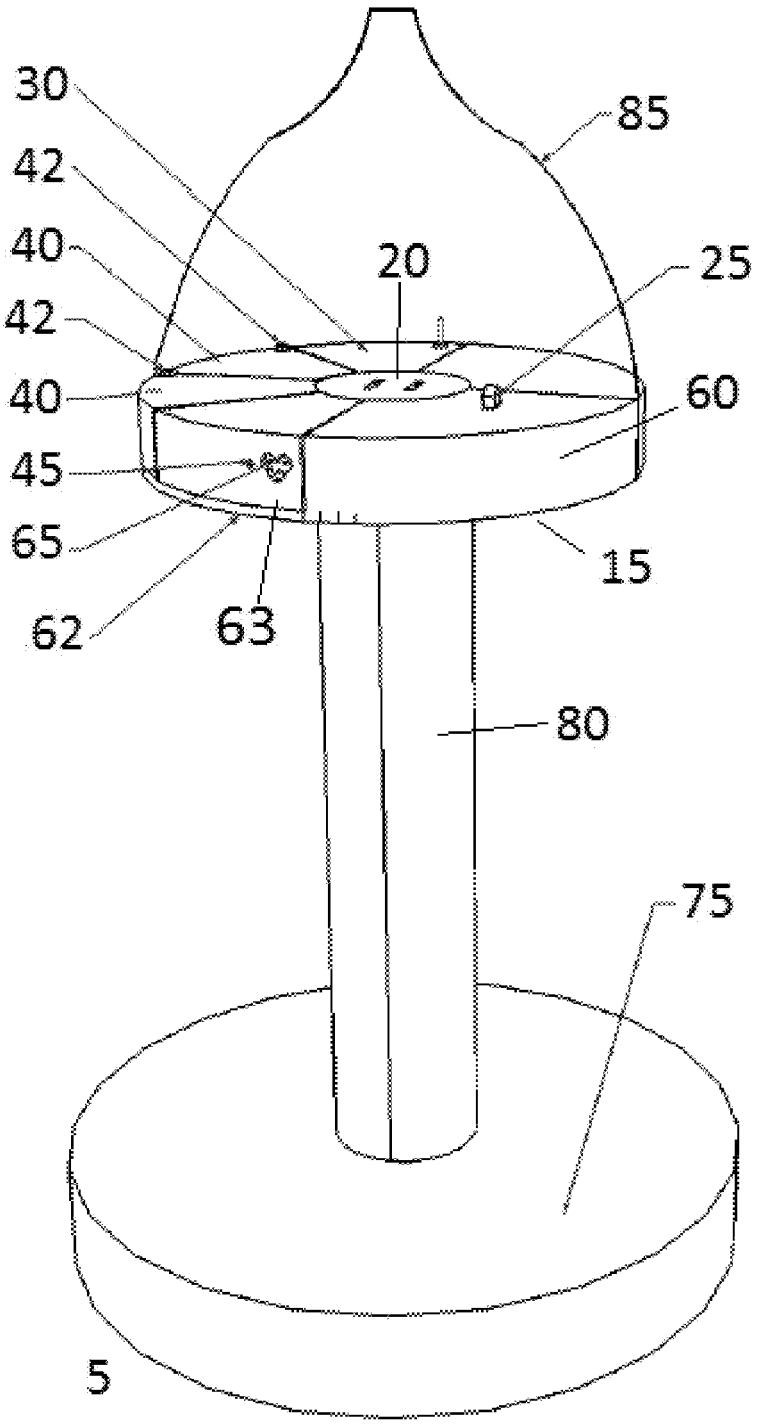
FIG. 3 shows an orthogonal view of one embodiment of the invention intended for desktop use.

As shown in FIG. 3, the invention as currently assumed that ac power is provided to the Lamp 5 from an IEC 60320 C-5 power cord or similar industry standard cord to a matching C-6 AC Inlet Plug 65 in the body of the Lamp 5, but there are a multitude of suitable power cord and power inlets that are commercially available and known in the art.

As currently configured, the DC Power Inlet Connector 45 as designed to accept a barrel connector plug from a readily available off-the-shelf universal power supply, typically converting any alternating current input power of 85 Vac to 265 Vac input to a suitable DC source to power the Power Control Module 60. Suitable universal power supplies are well known in the industry in both desktop and wall plug forms, providing a dc-output with sufficient wattage to power the invention while charging the Battery Packs 40.

As currently configured, the DC Power Inlet Connector 45 accepts a 12 Vdc input, but the invention is not limited; the input voltage need only match the circuitry within the Power Control Module 60 so the Module 60 can convert the incoming power for use in charging the Battery Packs 40 and the voltage sources to power the Lighting Control Module 20 and Wireless Communication Module 30.

The embodiment shown in the figures have an External Power Module, in which the ac power received through an AC Power Inlet Plug 65, or DC Power Inlet Connector 45 are received.

The drawings do not show the dc power supply source, as it is not part of the invention. Suitable universal dc power sources include both desktop or wall-mount ac/dc adaptors barrel connectors, such as a 5.5×2.5 mm connector found on many power supplies used for home and mobile electronics.

The drawings do not show the latching mechanism or the type of electrical or physical connectors used to mount the Battery Pack 40, Wireless Communication Module 30 or External Power Source Module 63 in place. Any person with skill in the art can provide any number of connection solutions that would be acceptable, including a raised rim on the Housing 15 and connectors in the floor of the Housing 15 which connect to the various load types, or connectors on the side of the raised central circular portion of the Housing 15 which lock in with the pie-shaped loads when they are mounted in the Housing 15. This application includes no claims to connection type or mounting approach used to affix the aforementioned loads that may be mounted in the Load Slots 62.

The Lamp 5 comprises one or more Battery Packs 40. Each Battery Pack 40 may include an Indication LED 42 on the Pack 40 to notify a user that the Pack 40 needs charging. The indication that a Battery Pack 40 needs charging can be made in a multitude of way, including but not limited to, an LED indicating the charge is sufficient, an LED indicating that the charge is insufficient, or a change in indicator color, e.g., from green to red.

As shown in the figures, Lighting Control Module 20 energizes the Lighting Surface in accordance with the user's input. Such input can be a complex program received by the Wireless Communication Module 30, or by means of a Switch 25 mounted on the lamp housing.

Though the figures show the Lighting Control Module 20 as the raised central circular area on the Housing 15, that portion is merely the interface. The Lighting Control Module can use that section of the Housing to mount connectors to the Battery Packs 40, Wireless Communication Module 30 and External Power Source Module 63, and using those connections, the circuit physically shares the portion of the enclosed Housing 15 that, in the current embodiment comprises all of the Housing that is not part of the four Load Slots 62, e.g., the raised circular area and half of the Housing 15, including the Lamp Switch 25.

The Switch 25 can be a simple on/off state that turns the LEDs on the Lighting Surface 10 from off to fully bright, or a radial or slide switch providing a resistance signal to the Control Module which controls the brightness gradually from off to its maximum rating.

Figure 6A:
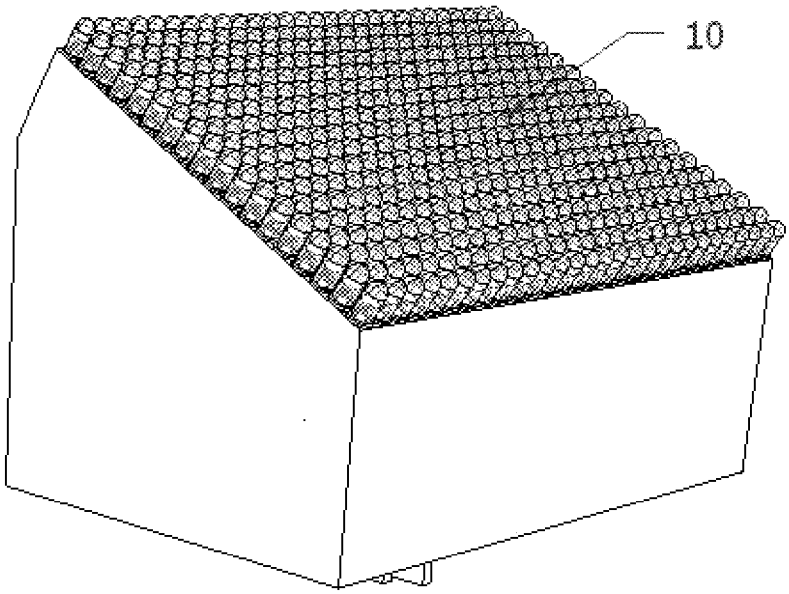
FIG. 6A shows a fixed inclined rotatable lighting surface.
Figure 6B:
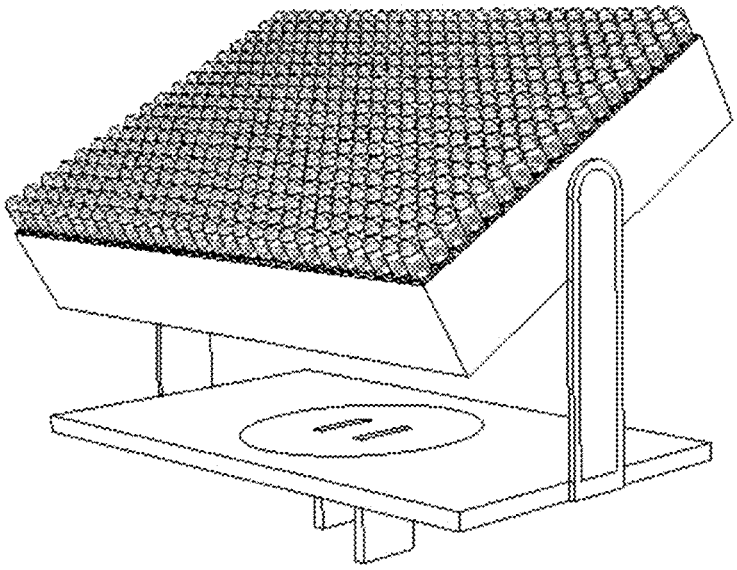
FIG. 6B shows an adjustable inclinable rotatable lighting surface.
Figure 6C:
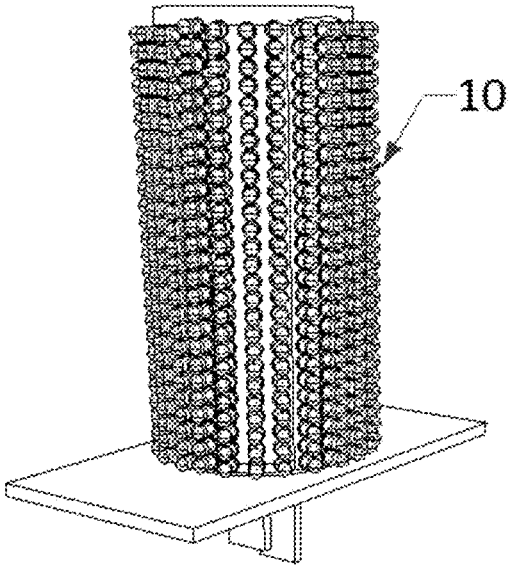
FIG. 6C shows a cylindrical lighting surface.
Figure 6D:
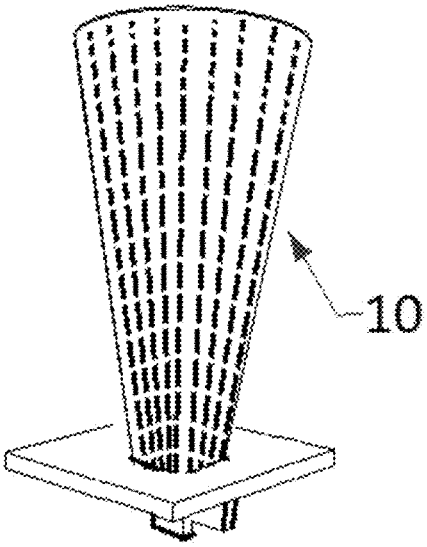
FIG. 6D shows an inverted conical lighting surface.
Figure 6E:
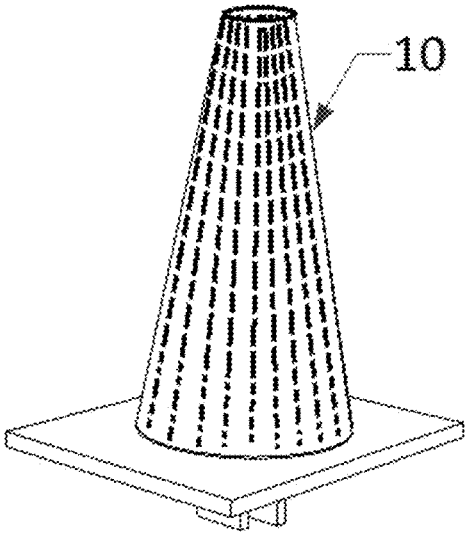
FIG. 6E shows a conical lighting surface.
Figure 6F:
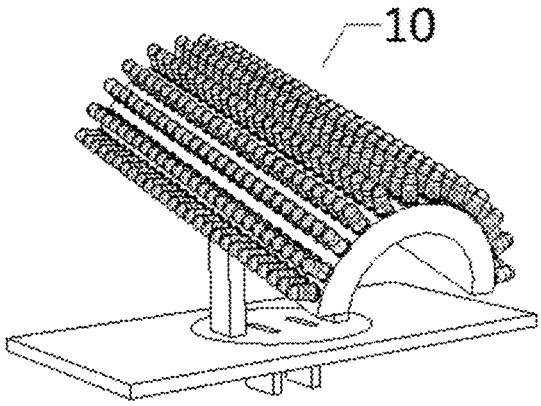
FIG. 6F shows a rotatable inclinable curved lighting surface.

The Lighting Surface 10 may be constructed in a number of ways, including a flat surface that is fixed in its orientation (FIG. 6A), a flat surface that may be user-directed (FIG. 6B), or curved and shining light from the Lamp 5 in all directions axially from the surface (FIG. 6C), or a conical shape that shines light axially and downward from the Lamp 5 (FIG. 6D), axially and upward from the Lamp 5 (FIG. 6E), or a radial or conical sectional that directs light only in a desired direction (FIG. 6F).

An infinite number of configurations and constructions are possible, including multiple surfaces with individual Surface Switches 27 to control different color LEDs on different surfaces, or even on the same surface. FIG. 6 shows a White LED Switch 27 and Blue LED Switch 29.

The illustrated drawings included in the figures are not intended to be limiting, but only exemplars of some of the possibilities.

The Wireless Communication Module 30 is an optional element of the Lamp 5 which communicates with a Wireless Base Station 70. Simpler embodiments of the invention do not include this module. The Wireless Communication Module 30 is intended to be used when a number of Lamps 5 are used at one time, and a user is concerned that the battery life will be insufficient for the expected use. For example, a dozen Lamps 5 might be employed at a wedding held in a park or other venue that has insufficient power available. The abilities of the Wireless Communication Module 30 can be to simply send lamp identification and charge level to a central user monitoring station by a simple Zigbee network (IEEE 802.15 standard), or a more complex Wireless USB, Bluetooth, or Wi-Fi network. Any or all of these types of networks can be used, depending on the distance needed and the equipment available on a site.

A more complex embodiment of the invention will allow a user to send programming information to each Lamp 5, dimming the light for slow songs at a party, for example, or to turn on colored lighting as desired. This programming is fairly simple and known in the industry.

The optional Wireless Base Station can be a stand-alone console control of the Lamp 5, receiving battery charge level signals from the Wireless Communication Module 30 and instructing the Lamp 5 to operate, and at what brightness. An alternative approach is to use software and a Wi-Fi connection to a computer.

Figure 1:
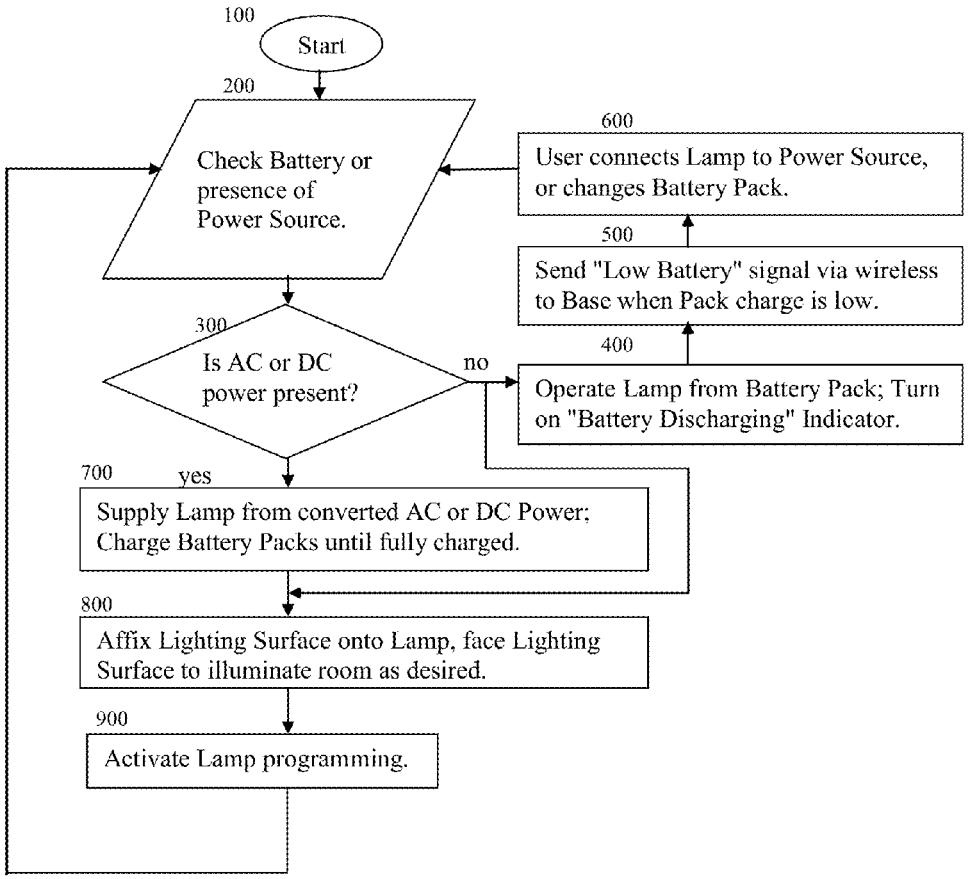
FIG. 1 depicts a first embodiment of an operational flowchart of the invention.

FIG. 1 depicts an operational flowchart of one embodiment of the invention. As shown, after the user energizes the Lamp 5 by turning the Switch 25 (Step 100), the circuitry of the Lamp 5 checks to see which power sources are available (Step 200). After determining whether external power is present at the DC Power Inlet Connector 45 or AC Power Inlet Plug 65 (Step 300), the Lamp will automatically operate from the external source and charge the Battery Packs 40 to a full charge, and then trickle charge them (Step 700).

During operation, a user affixes the preferred Lighting Surface 10 to the Lamp 5, and position the Lamp 5 so it shines light to the desired area (Step 800).

Once positioned, the user can activate any Lamp 5 programming via the Wireless Communication Module 30 from the Wireless Base Station 70, or simply turn the Lamp 5 on by the Lamp Switch 25 (Step 900).

If no external power supply is detected (Step 300), then the Lamp 5 operates from the Battery Pack(s) 40 (Step 400). In this embodiment, when the Battery Pack 40 is near its life's end, the Lamp sends a signal to the Wireless Base Station 70 (Step 500). In other embodiments, no signal might be sent, but an LED change of status on the Battery Pack will give the user warning that the Battery is near discharge. In either case, the user will change Battery Packs 40 or connect the Lamp to an external power source, which charges the Battery Packs (Step 600).

Figure 2:
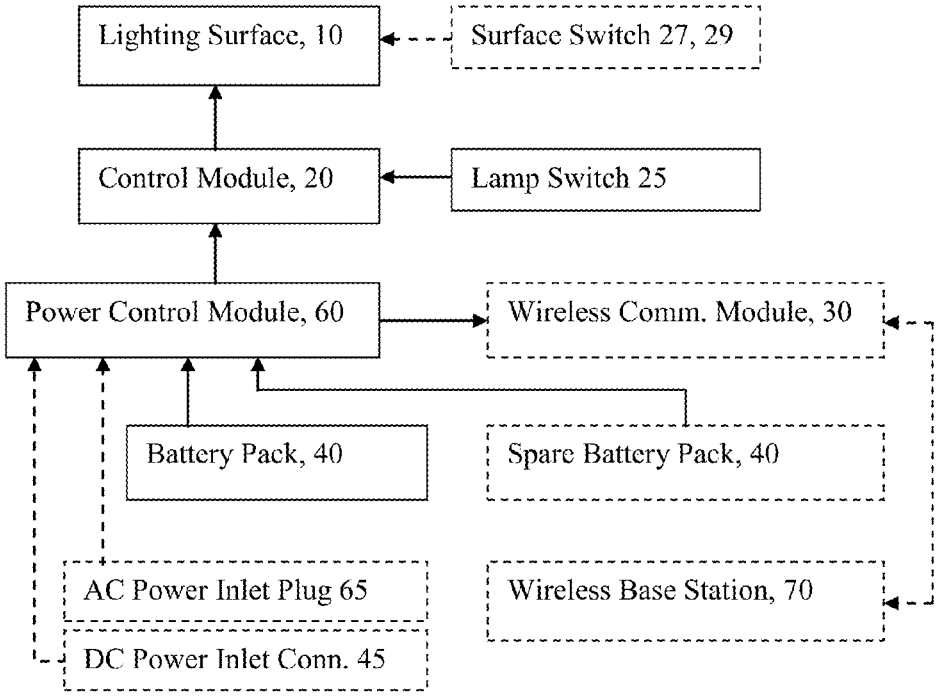
FIG. 2 shows the control and interconnection of one embodiment of the physical components of the invention.

FIG. 2 depicts a first embodiment of the physical components of the invention. As shown, optional Surface Switches 27 29 control specific parts of the Lighting Surface 10. Lamp Switch 25 energizes the Lighting Control Module 20, turning the Lamp 5 off or on, or somewhere in between.

Figure 4:
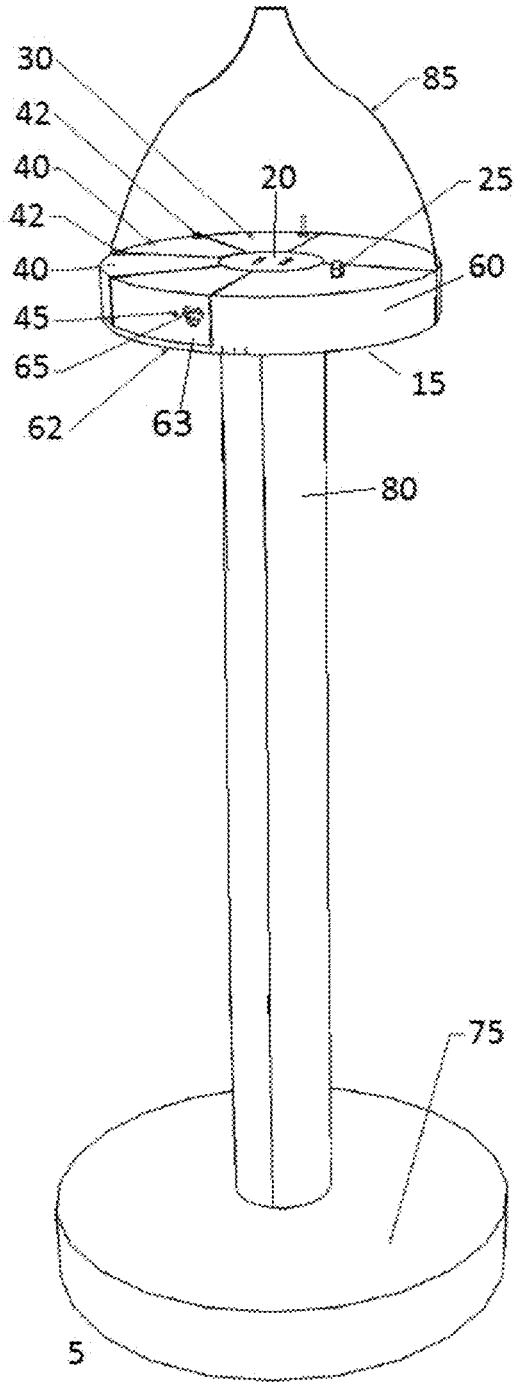
FIG. 4 shows an orthogonal view of a second embodiment of the invention intended for floor use.

Though lampshades are often replaced on lamps, the traditional ac wall-plug powered lamp requires a physical cord for its power which usually extends from a light bulb socket through the lamp stem and out of the base, making ornamental changes to a lamp base difficult. A substantial advantage of this invention is the ability to configurable a Lamp Base 75, Lamp Stem 80 and Housing 15, as the lack of a power cord allows users to change a Stem 80 length without the complexity of an added power cord. See FIGS. 3 and 4 for examples of the Lamp 5 configured as desktop and floor lamps, respectfully.

This infinitely configurable aspect can be exploited in the commercial rental industry, as outdoor weddings often need lighting in areas without sufficient access to electrical power, a need to avoid the sound pollution of a generator, and a way to discern when a lamp's battery should be changed. In forest settings, all the lamps can be configured to contrast with the forest floor with white Lamp Bases 75, Stems 80, and Housings 15, or be part of a hunting decoration scheme employing camouflage patterns. Whatever the party host prefers, the electronics remains the same, and the ornamentation can be changed to reflect the decor's needs. Even a party held in the ruins of an old building can be properly lit with the Lamp Housing 15 held on a wall with a sconce-type mounting. In yet another alternative, nothing prevents the Lamp 5 from being hung from a ceiling.

Thus, the invention is infinitely configurable, from a desk-mount, floor-mount, sconce-type wall-mount, or hanging from a ceiling, and provides varying brightness and LED lighting color in all directions, or in a specific arc around the lamp, and indicates when a battery should be charged.

A legend of the drawings includes:

AC Power Inlet Plug 65
Battery Pack 40
Control Module 20
DC Power Inlet Connector 45
External Power Source Module 63
Housing 15
Indication LED 42
Lamp 5
Lamp Base 75
Lamp Stem 80
Lamp Switch 25
Lighting Surface 10
Load Slots 62
Power Control Module 60
Shade Mount 85
Surface Switch 27, 29
Wireless Base Station 70
Wireless Communication Module 30

What is claimed is:

1. A lamp comprising: a) one or more interchangeable battery packs; b) a housing constructed to operate with a multiple number of the battery packs, in which electrical circuitry resides inside the housing that converts power from the battery packs to conditioned dc power capable of powering a set of LEDs, such battery packs configured to provide power in parallel or to sequentially drain one battery pack at a time; c) an LED lighting surface powered by said conditioned dc power, d) a wireless communication element which wirelessly communicates with a base station, such base station constructed as a stand-alone console, or a computer connected by a wireless protocol and appropriate software in which an optional communication element physically mounts into one of the battery pack module positions, that particular module position in the housing constructed with two sets of electrical connections, one set which connects to a battery pack module, and a second set that is appropriate for proper operation of the communication element, but both types of modules physically mounting into the same housing, so that a user can choose between operating the lamp with wireless communications or operate with an additional battery pack, in which a user may replace a battery pack without interrupting lamp operation when the lamp is connected to an external power source, or a second battery pack module remains connected.

2. A lamp comprising: a) one or more interchangeable battery packs; b) a housing constructed to operate with a multiple number of the battery packs, in which electrical circuitry resides inside the housing that converts power from the battery packs to conditioned dc power capable of powering a set of LEDs, such battery packs configured to provide power in parallel or to sequentially drain one battery pack at a time c) an LED lighting surface powered by said conditioned dc power, d) a wireless communication element which wirelessly communicates with a base station, such base station constructed as a stand-alone console, or a computer connected by a wireless protocol and appropriate software, e) a means to accept and use an external ac source, dc source or both to power the lamp, and optionally charge each battery pack independently from an external power source, such that battery packs may be charged, removed, and replaced while the lamp continues in operation, so long as either the external power source is present, or a single battery pack remains connected to the housing, and f) in which the means for accepting an external source of power is constructed as a user-removable module that is replaceable by a battery pack module, the external source of power constructed as an optional accessory module that fits into a particular battery pack module position, that particular module position in the housing constructed with two sets of electrical connections, one set which connects to a battery pack module, and a second set that is appropriate to connect to the optional external power source, but both types of modules physically mounting into the same housing, so that a user can choose between operating the lamp using the optional external power source or with an additional battery pack.

* * * * *